United States Patent [19]

Forest

[11] Patent Number: 4,624,157

[45] Date of Patent: Nov. 25, 1986

[54] POCKET SHARPENER FOR KNIVES

[76] Inventor: Charles W. Forest, 33 Sleepy Hollow La., Orinda, Calif. 94563

[21] Appl. No.: 808,026

[22] Filed: Dec. 12, 1985

[51] Int. Cl.[4] ..... B21K 5/12

[52] U.S. Cl. ..... 76/86

[58] Field of Search ..... 76/82, 82.2, 86, 88, 76/DIG. 11; 51/205 WG, 211, 214, 285

[56] References Cited

U.S. PATENT DOCUMENTS

| | | | |
|---|---|---|---|
| 585,942 | 7/1897 | Smith | 76/86 |
| 785,048 | 3/1905 | Richie | 76/86 |
| 950,530 | 3/1910 | Dow | 76/86 |
| 1,041,631 | 10/1912 | Johnson | 76/86 |
| 1,952,106 | 3/1934 | Vierling | 51/214 |
| 2,505,911 | 5/1950 | Ransom | 76/86 |
| 4,494,340 | 1/1985 | Carter | 76/82 |

*Primary Examiner*—Roscoe V. Parker
*Attorney, Agent, or Firm*—Bielen & Peterson

[57] ABSTRACT

A unitary pocket sharpener for knives is constructed from first and second overlaid metal discs each having a section with a straight edge, the edges being mutually arranged to form a wedge-shaped gap of approximately 40°. On each straight edge is brazed a rectangular carbide tooth, longitudinally positioned on opposed segments of the straight edges such that the two juxtaposed teeth cross forming a similar wedge-shaped gap with a narrow space between the crossed teeth. The teeth each have a compound-beveled sharpening edge which respectively engage each side of a knife blade that is lodged in the small gap and drawn across the teeth in a uniform stroke for sharpening the knife.

7 Claims, 3 Drawing Figures

POCKET SHARPENER FOR KNIVES

BACKGROUND OF THE INVENTION

This invention relates to a device for sharpening cutlery, particularly cutlery having a blade that tapers to a thin edge. The devised sharpener is ideal for sharpening a pocket knife as it has a compact construction that makes the sharpener convenient for being personally carried in a user's pocket or change purse. There are a variety of devices for sharpening cutlery from grinding wheels and sharpening stones to files and specialized edge stripping devices for blades having a tapered edge.

While tapered edge sharpening can be accomplished with traditional sharpening devices such as grinding wheels and sharpening stones that consist of a composition abrasive material that is generally drawn across the edge of the cutlery blade, this requires a skill in accurately orienting the blade at a select optimum angle on drawing the blade across the stone or stone across the blade. This action must be performed repeatedly on each side of the blade to properly sharpen the blade. A skillfully honed knife sharpened with a whetstone undoubtedly provides the sharpest cutting edge. However, if ineptly performed, a stone sharpened knife can result in a blade that is duller than before the attempted sharpening.

Other devices such as a butcher's steel sharpens a blade by a combination cross draw, longitudinal sliding motion on each side of the blade by a cylindrical, finely fluted metal file. The butcher's steel is relatively large in size and is ideally suited for imparting a finished edge to large knives and cleavers.

Strip sharpeners of the type related to this invention operate longitudinally along the edge to simultaneously shave both sides of a tapered blade edge. Strip sharpeners have the advantage of automatically providing a proper angle of taper to the blades edge. Sharpening by edge stripping allows for compact design of the sharpener. The strip sharpener of the invention is particularly compact in size and inexpensive to manufacture and comprises an improvement in design and construction over prior sharpeners.

SUMMARY OF THE INVENTION

The sharpening device of this invention is particularly designed to strip sharpen tapered edge blades and because of its compact size is ideally suited for sharpening pocket knives. The sharpener has a unitary flat construction that is compact in size and suitable for pocket portage. One preferred embodiment configuration is circular, sized approximately to a fifty cent piece. The embodiment of the configuration is designed to be carried in the manner one carries his change, for example in one's change purse or pocket. Another embodiment configuration is oblong for improved holding during operation. The flat compact design of both embodiments allows the device to be adapted for use as an object of advertising, a momento, a key chain tag, or a money clip.

The unitary pocket sharpener of this invention is constructed with first and second overlapped flat metal discs. Each disc has at least one straight edge segment. The straight edge segments on the two discs are mutually arranged to form a wedge shaped gap when the discs are overlapped and secured together. On each straight edge segment is secured an elongated rectangular tooth of hard material. In the preferred embodiment the material is tungsten carbide, which is secured to each steel disc by brazing. A composition ceramic or diamond impregnated material may also be used and secured by a means compatible with the material utilized for the stripper edge. The teeth are positioned on opposed straight segments of the discs such that they cross forming a similar wedge-shaped gap with a narrow space between the crossed teeth on the overlapped discs.

The two teeth each have a compound beveled edge which respectively engage each side of the tapered edge of the knife blade. The knife blade is sharpened by inserting the base of the blade in the wedge-shape gap between the teeth and drawing the blade across the teeth with the axis of the blade perpendicular to the plane of the overlapped discs.

The fixed angle of the gap and the fixed bevel of the juxtaposed teeth insures that the proper edge will be imparted to the blade. One or two strokes is generally sufficient to sharpen a blade. The strip sharpener of this invention is particularly useful for difficult to sharpen stainless steel blades. These and other features will be described more fully in the detailed description of the preferred embodiments.

DETAILED DESCRIPTION OF THE PREFERRED EMBODIMENTS

Figure 1:
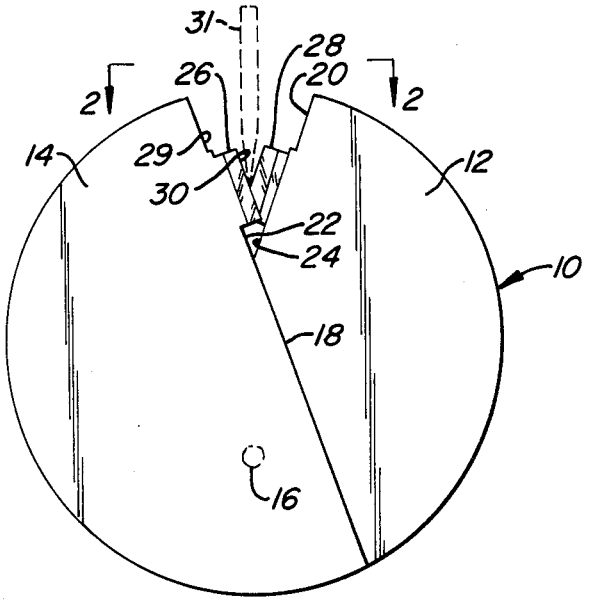
FIG. 1 is a top view of the pocket sharpener.
Figure 2:
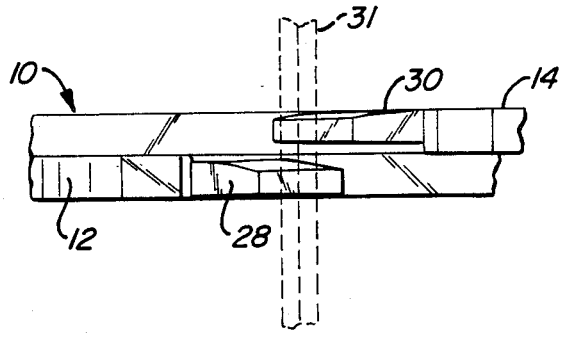
FIG. 2 is an enlarged end view in a section along the lines 2—2 of FIG. 1.

Referring to FIGS. 1 and 2 of the drawings, a first embodiment of a unitary pocket sharpener 10 is shown. The pocket sharpener 10 is of a stripper type that engages the tapered edge of a blade and shears metal from each side of the blade edge to produce a sharpened blade.

The strip sharpener 10 of this invention is constructed from first and second metal discs, 12 and 14 respectively, which are overlapped as shown and secured together by a spot weld 16. Each of the two discs 12 and 14 has a straight edge 18. The edges 18 are mutually arranged to form a wedge-shape gap 20 with opposed edge segments 22 and 24 forming an angle of approximately 40°. This angle is considered optimum for most knives of the type intended to be sharpened by the pocket sharpener. A reduced angle will provide a keener but more easily damaged edge and an increased angle will provide a blunter more durable edge. For a pocket knife, which is a general purpose instrument, the selected angle is appropriate. On each exposed edge, 22 and 24 is mounted a rectangular stripping tooth 26 and 28. The teeth cross providing a narrow wedge-shaped gap 30 of the same angle as the straight edge segments 22 and 24. The elongated teeth 26 and 28 are longitudinally mounted on the straight edge segments with the aid of a locating notch 29. The teeth are positioned and mounted in step fashion as shown in the side view of FIG. 2. The teeth are secured by brazing which for the preferred tungsten carbide material of each tooth is a compatible with second means the preferred steel material of the discs. Each tooth has a compound beveled edge with a 15 degree bevel to the top edge and a 5 degree bevel to the side edge. The narrow space between crossed teeth eliminates the potential for entrapment of minute shavings or chips at the crux of the crossing.

The fixed arrangement of discs and teeth assures the ease of accurate sharpening. To sharpen a knife blade 31, shown in phantom the sharpener is carefully held between thumb and curled forefinger, with the top bevels facing up.

The user's dominant hand holds the knife. The wedge-shaped gap is positioned forward of the thumb and oriented to the side facing the free hand. The knife blade 31 is oriented substantially vertically to the plane of the coupled discs with the blade tip leaned slightly toward the sharpener. The blade edge is engaged with the crossed teeth proximate the hilt and angularly centered in the wedge-shaped gap. The knife is carefully drawn downwardly, continuing the engagement of the sharpening teeth with the tapered blade edge until the tip passes the teeth. A moderate to light pressure is all that is required with only a small number of passes needed to fully sharpen a blade.

Alternately, the sharpener can be pressed against the edge of a table top or other ledge structure with a portion of the sharpener having the gap cantilevered over the edge. Again holding the knife in the free hand and engaging the teeth of the sharpener with the tapered blade proximate the hilt with upwardly oriented and slightly tilted tip, the knife is drawn downward with light pressure against the sharpener to sharpen the blade.

Figure 3:
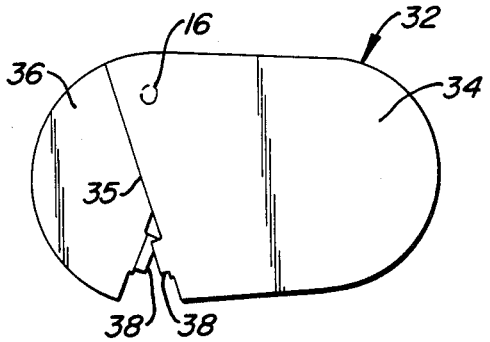
FIG. 3 is a top view of an alternate embodiment of the pocket sharpener.

In the alternate embodiment of FIG. 3 the sharpener 32 is constructed with an oblong disc 34 with a truncated end 35 coupled to a semicircular disc 36 in overlapped arrangement as in the previously described embodiment. The oblong disc provides the user with an enlarged gripping surface for hand holding the sharpener during use. The sharpener 32 includes the same arrangement of crossed teeth 38 which engage the tapered edge of a blade for strip sharpening as described.

While in the foregoing embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A unitary pocket sharpener comprising:

first and second discs each having a straight edge segment, said discs being overlapped and fixedly secured with said straight edge segments defining an open wedge-shaped gap;

first and second elongated rectangular teeth arranged on said straight edge segments such that said teeth cross forming a small wedge-shape gap of approximately 40°, wherein said teeth are fabricated of a hardened material and beveled at a cutting angle for stripping the edge of a tapered blade positioned in the small gap with the blade edge against the crossed teeth when the blade is drawn across the teeth.

2. The unitary pocket sharpener of claim 1 wherein the discs have a first thickness and the rectangular teeth have a second thickness less than the first thickness of the discs and wherein the teeth are mounted on the edge segments of the disc such that there is a narrow space between crossed teeth.

3. The unitary pocket sharpener of claim 1 wherein said discs are semicircular in configuration.

4. The unitary pocket sharpener of claim 1 wherein one disc is semicircular and the other disc is oblong with a truncated end.

5. The unitary pocket sharpener of claim 1 wherein the teeth each have a compound bevel with a top edge angle of 15° and a side edge angle of 5°.

6. The unitary pocket sharpener of claim 1 wherein the discs are fabricated of steel and the teeth are fabricated of tungsten carbide, said teeth being brazed to the discs.

7. The unitary pocket sharpener of claim 1 wherein the straight edge segments each have a locating notch for positioning the teeth on the straight edge segments.

* * * * *